United States Patent [19]

Lazzaro

[11] 3,970,973

[45] July 20, 1976

[54] IMPEDANCE STANDARD APPARATUS

[75] Inventor: Frank Lazzaro, Lancaster, Ohio

[73] Assignee: The United States of America as represented by the Secretary of the Air Force, Washington, D.C.

[22] Filed: Sept. 25, 1974

[21] Appl. No.: 509,200

[52] U.S. Cl. ..... 333/97 R; 333/34; 333/98 R

[51] Int. Cl.[2] ..... H01P 1/24; H01P 3/12; H01P 1/04

[58] Field of Search ..... 333/34, 97 R, 98 R; 324/58 R, 58 A, 58 B

[56] References Cited

OTHER PUBLICATIONS

Lance– "Introduction to Microwave Theory and Measurements" McGraw–Hill, New York, 1964; Title Page and pp. 118–119.

Gunston et al. – "A Broad–Band Low VSWR H–Plane Waveguide Taper" in The Microwave Journal Dec., 1962; pp. 69–71.

*Primary Examiner*—Alfred E. Smith
*Assistant Examiner*—Marvin Nussbaum
*Attorney, Agent, or Firm*—Joseph E. Rusz; William Stepanishen

[57] ABSTRACT

An impedance standard apparatus for providing a mathematically predictable voltage standing wave ratio between a matched generator and load.

7 Claims, 5 Drawing Figures

IMPEDANCE STANDARD APPARATUS

BACKGROUND OF THE INVENTION

The present invention relates broadly to impedance standards and in particular to an impedance standard apparatus for calibrating microwave impedance instrumentation.

In the prior art, impedance can be measured in transmission lines by analysis of the behavior of electric fields propagating along their axes. In an idealized coaxial line or waveguide with lossless, unity dielectric-constant insulation and perfectly conducting walls, a wave will propagate along the axis without alteration so long as the cross-sectional dimensions remain uniform. The relationship between the electric and magnetic fields will remain constant; and because they are respectively proportional to voltage and current, the ratio of these fields will define an impedance for the line.

When the wave reaches the end of the transmission line, a portion determined by the impedance discontinuity at that point is reflected backwards toward the source. The incident and reflected waves then add together to form a stationary interference pattern, or standing wave, that has maxima and minima occurring alternately at intervals of a quarter wavelength. The maxima occur at those points at which the waves reinforce each other and measure the sum of the two amplitudes; the minima, conversely, measure their difference. The ratio of maximum to minimum voltage is called the voltage-standing-wave ratio (VSWR).

The present invention provides a standard impedance apparatus by which such measurements may be made quickly and accurately.

SUMMARY

The present invention utilizes a tapered section in either a waveguide unit or a coaxial line section to provide an impedance standard apparatus for calibrating automatic network analyzers. The impedance standard apparatus is a two-port device which introduces a mathematically predictable voltage standing wave ratio (VSWR) when inserted between a matched generator and a matched load.

It is one object of the invention, therefore, to provide an improved impedance standard apparatus to produce a known reflection to calibrate a reflection measuring instrument.

It is another object of the invention to provide an improved impedance standard apparatus having a tapered section therein, whereby a known reflection is produced.

It is yet another object of the invention to provide an improved impedance standard apparatus wherein the alignment holes are the same on both sides of the standard.

It is still another object of the invention to provide an improved impedance standard apparatus which provide broadband operation over the complete frequency range in a designated band.

These and other advantages, features and objects of the invention will become more apparent from the following description taken in connection with the illustrative embodiment in the accompanying drawings.

DESCRIPTION OF THE PREFERRED EMBODIMENT

Figure 1:
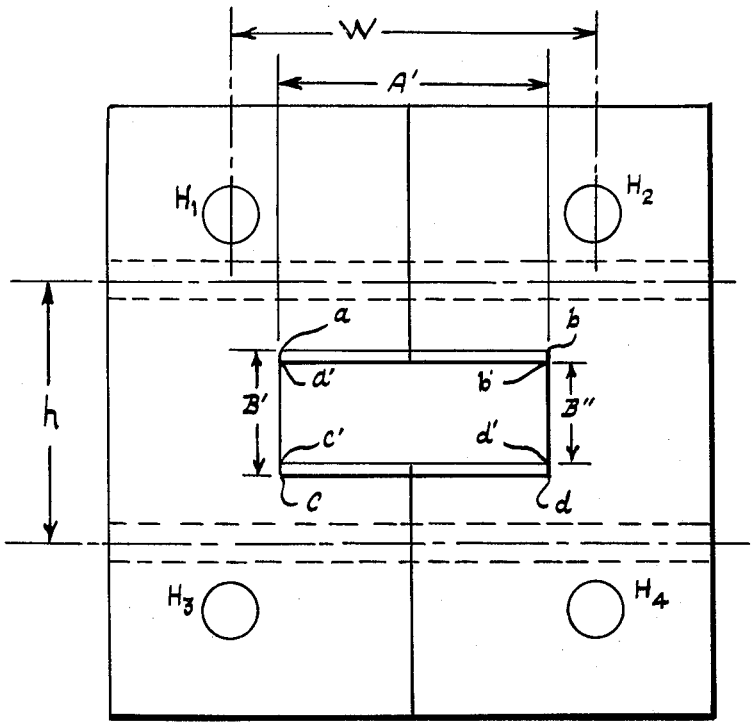
FIG. 1 is a plane view of the impedance standard apparatus which may be utilized in a waveguide system.

The theory of operation of the impedance standards will be best understood by referring to FIG. 1 and by defining the terms which are applicable to the apparatus shown in FIG. 1. The following statements apply to the waveguide impedance standard. (1) A′ and B′ define the nominal size of the waveguide. (2) The volume defined by the aperture, *a b c d*, the length L, and the aperture *a′b′c′d′*, is known as a waveguide. This type of waveguide is mostly operated in the $TE_{10}$ mode which mode designates the configuration of the electric field and the magnetic field propagating in the waveguide. The waveguide impedance standards herein shown operate in the $TE_{10}$ Mode. (3) The A′ dimension determines the lowest microwave frequency which can travel in the waveguide. (4) $H_1$, $H_2$, $H_3$ and $H_4$ are alignment holes which are used to align waveguide components and to accommodate bolts to fasten them together. The center line of aperture *a b c d* and the center line of aperture *a′b′c′d′* must be the same center line and the center lines of each of the alignment holes, $H_1$ through $H_4$ will be equidistant therefrom. (5) $h_1$, $h_2$, $h_3$, $h_4$, $h_5$, and $h_6$ are holes which accommodate cap screws or bolts to fasten the standard together (the standard is milled in two pieces and then fasten). (6) Dimension B″ determines the nominal value of the impedance standard.

The table I gives dimensions of the waveguide impedance standards in the commonly used waveguide bands.

In common impedance instrumentation calibrations, i.e., in calibrating a slotted line or reflectometer, a matched load is connected to the surface with aperture, *a b c d*. A known reflection coefficient will occur at aperture, *a′b′c′d′*, and the surface with aperture, *a′b′c′d′*, is connected to the impedance instrument under calibration. Note that the impedance instrumentation under calibration has an aperture of the nominal waveguide dimensions *a b c d* and that its alignment holes are the same as those of the impedance standards.

An impedance standard is often called a standard mismatch. The best commercially available standard mismatch is the FXR 510 series. These prior art standards are made with the surface, *a′b′c′d′*, and the surface *a b c d* equal, i.e., the B″ dimension is the same throughout the length of the standard mismatch; the value of B″ is different than the value of B′ to which the standard mismatch is connected. The standard mismatch contains a matched load to absorb the microwave energy which is not reflected at reference plane, P, the point of discontinuity in the conventional standard. Since this type of standard contains its own load, it is longer by necessity than the present invention.

Table 1

| L (inches | EIA WR | JAN RG | A' (inches) | B' (inches) | W (inches) | h (inches) | Guide Pin Hole Diam. | Freq. Range (GHZ) | |
|---|---|---|---|---|---|---|---|---|---|
| 0.6 to 25 | 112 | 51/U | 1.122 | 0.497 | 1.352 | 1.474 | .169" | 7.05 to 10.0 | 0<B" < A' |
| 0.6 to 24 | 90 | 52/U | 0.900 | 0.400 | 1.220 | 1.280 | .169 | 8.2 to 12.4 | O<B" < A' |
| 0.4 to 15 | 62 | 91/U | 0.622 | 0.311 | 0.994 | 0.956 | .144 | 12.4 to 18.0 | 0<B" < A' |
| 0.25 to 11 | 42 | 66/U | 0.420 | 0.170 | 0.640 | 0.670 | .116 | 18.0 26.5 | 0<B" < A' |
| 0.20 to 8 | 28 | 96/U | 0.280 | 0.140 | 0.500 | 0.530 | .116 | 26.5 40.0 | 0<B" < A' |

Note B" determines the nominal value of the impedance standard. Any value of B" could be used with any value of L The standard which is shorter is connected just before the existing matched load (the H.P. 914 for example) and may be fabricated for approximately half the cost of the FXR 510 series. The present impedance standard is unique in the fact that a tapered section of waveguide is used to connect a waveguide of the same, A dimension but of different B' dimension. Although the use of E-plane tapered waveguides is well known in the prior art, these tapers are used to minimize the reflections of microwave energy when connecting waveguide of different B' values but of the same A' value. This point relates to two important points which make the present invention quite novel: (1) the present impedance standard is used to produce a reflection and thereby calibrate an instrument whose purpose is to measure reflections, (The E-plane tapers are used to minimize reflections when correcting waveguide of two different sizes), and, (2) the impedance standard apparatus is used to produce a reflection in waveguide of the same nominal size. The E-plane tapers are used to minimize reflections in waveguides of different sizes. The alignment holes are same on both sides of the impedance standard as shown in FIGS. 1 and 2.

Figure 2:
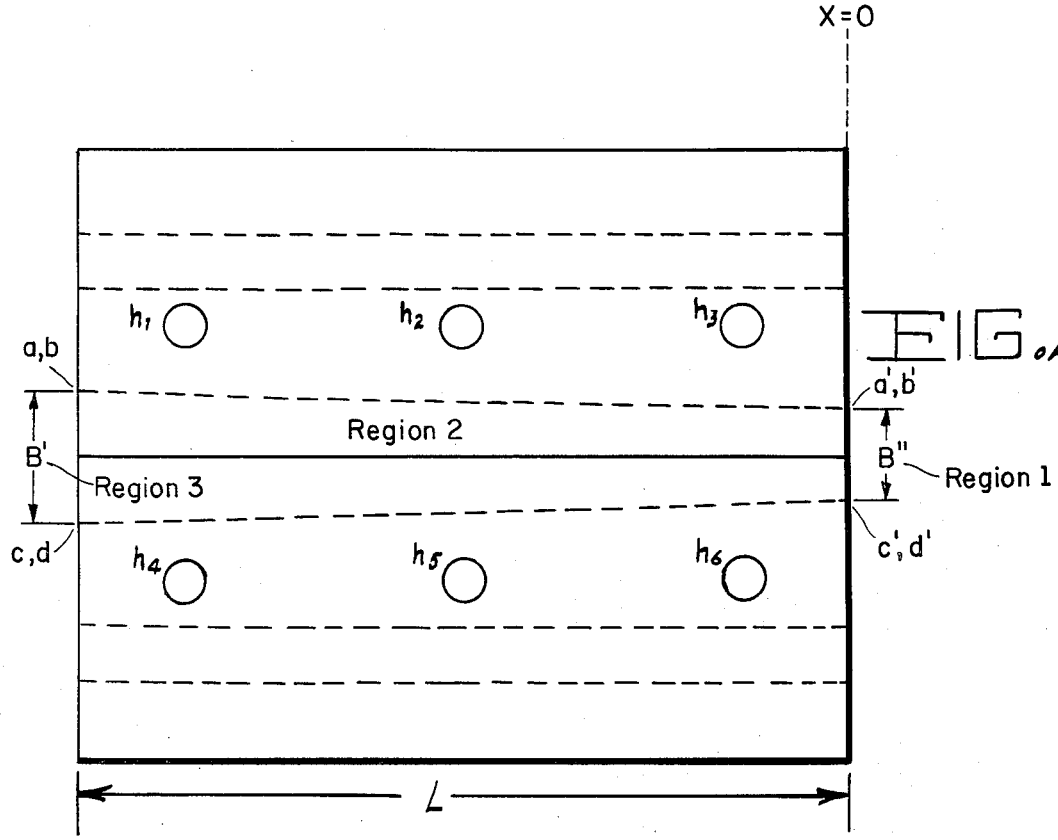
FIG. 2 is a side view of the impedance standard apparatus of FIG. 1 showing the tapered section.

The mathematical development of the waveguide impedance standard apparatus as shown in FIGS. 1 and 2 is as follows: region 1 is the area prior to the B" dimension of the impedance standard apparatus and is the area from which the microwave energy is applies; region 2 is the area of the taper of the impedance standard, having the reference point $x = o$ at the point B" with a length L which is measured from the point B" to the point B'; region 3 is the area following the impedance standard apparatus after the B' dimension and is the area in which the load is located. A reflection will occur at $x = o$, i.e., when the height of the waveguide changes from B' to B" The width of the waveguide is the same in all regions. From the discontinuity at $x = o$ the value of the reflection coefficient is given by $$\Gamma_{Dis} = \frac{B''/B' - 1}{B''/B' + 1} \qquad \text{Eq. 1}$$

The taper of region 2 also introduces a reflection at $x = o$. The reflection coefficient caused by the taper is:

$$\Gamma_{Tap} = \int_{o}^{L} \frac{dZ}{2Z} e^{-[j2BX + 2\alpha_w(x)X]} dX \qquad \text{Eq. 2}$$

where

Z is the impedance at any point in the taper (from $x = o$ to $x = L$)

$$Z = \left(\frac{Z_3 - Z_2}{L}\right) X + Z_2$$

$Z_2$ is the impedance at $x = O_+$, i.e., to the immediate right of $x = O$ $Z_2$ is proportional to B".

$Z_3$ is the impedance at $x = L$ $Z_3$ is proportional to B'.

dZ is the differential impedance in region 2.

$j = \sqrt{-1}$ $B = 2\pi\lambda g$ $\lambda_g$ is the wavelength in the waveguide $L$ is the length of the taper $\alpha_w$ (X) is the attenuation per unit length in the taper.

Figure 3:
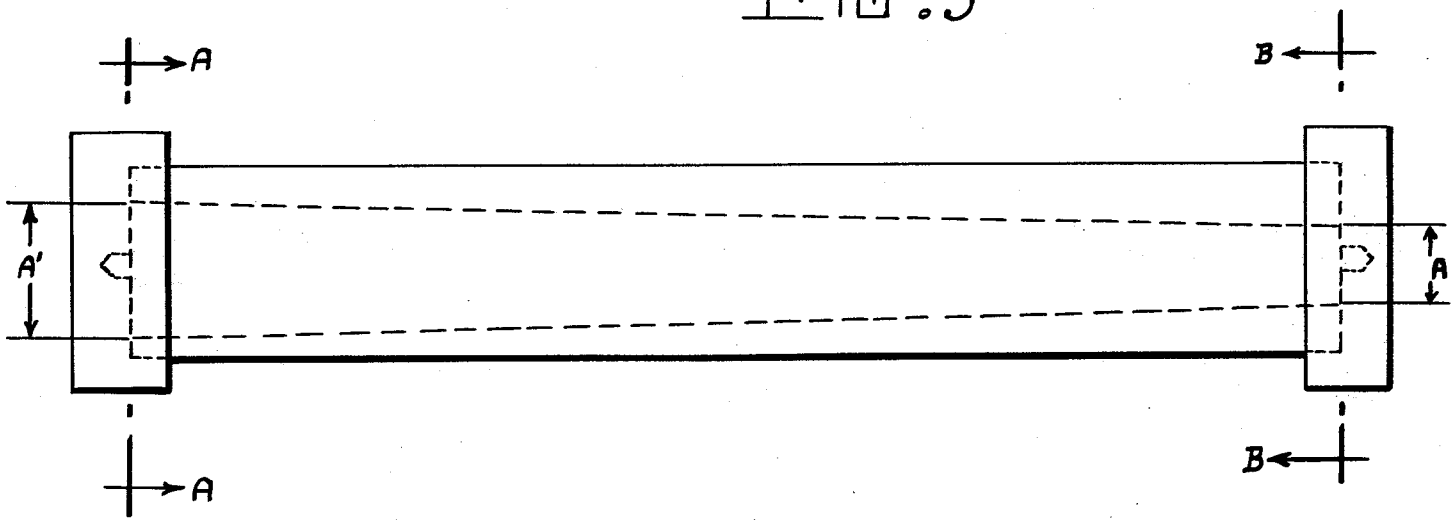
FIG. 3 is a plane view of the coaxial impedance standard apparatus in accordance with the present invention.

There is shown in FIG. 3 the coaxial impedance standard which will present a known reflection when inserted in a matched coaxial system. As with the waveguide impedance standards, the coaxial impedance standard may be used for calibrating common impedance instrumentation and for calibrating automatic network analyzers. The standards are designed in three coaxial line sizes, 3½ mm, 7 mm, and 14 mm (these are the approximate values of the inner diameter of the outer conductor.), these dimensions are designated as B in Table 2. In microwave measurements the common coaxial cross sectional dimensions are given Table 2 as follows:

TABLE 2

| | 3½ mm | 7 mm | 14 mm |
|---|---|---|---|
| A | 0.05985 | 0.1197 | 0.24425 |
| B | 0.13780 | 0.2756 | 0.5625 |
| B/A | 2.30 | 2.30 | 2.30 |

Coaxial tapers have been used to connect coaxial waveguides with the same B/A ratio but with different B and A dimensions. For example, a taper would be used to connect a 7 mm line size to a 14 mm line size. These tapers are used to minimize reflections.

The coaxial impedance standard which is shown in FIG. 3 is used in the same coaxial line size, i.e., these standards are inserted in a coaxial system which has the same B value and the same A value. These standards are used to produce a known reflection. The ratio B/A is not constant in the coaxial impedance standard. It should be noted that (1) the connectors are the same at each end of the coaxial impedance standard, (2) the value of B is constant throughout the length of the standard, (3) these standards are used to produce a known reflection, not to minimize reflections.

Figure 4:
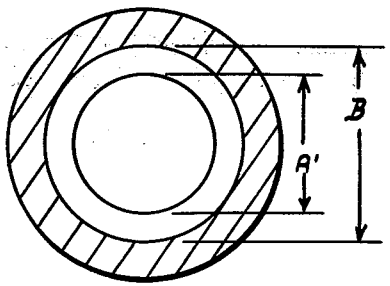
FIG. 4 is a cross-sectional view of FIG. 3 taken along lines A—A.
Figure 5:
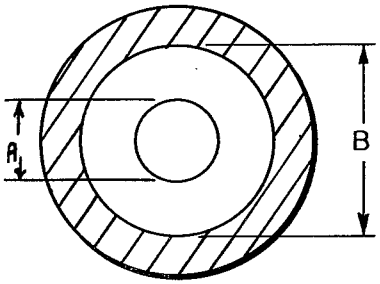
FIG. 5 is a cross-sectional view of FIG. 3 taken along lines B—B.

The mathematical development of the coaxial impedance standard apparatus as shown in FIGS. 3 through 5 is as follows: region 1 is the area prior to the A′ dimension of the impedance standard apparatus and is the area from which the microwave energy is applied, region 2 is the area of the taper of the impedance standard having the reference point $x = o$ at the point A′ with a length L which is measured from point A′ to point A; region 3 is the area following the impedance standard apparatus wherein the coaxial line has a constant dimension A and in which the load is connected.

$$Z_2 = \frac{1}{2\pi}(377) \ln \left(\frac{B}{A'}\right)$$

$$Z_3 = \frac{1}{2\pi}(377) \ln \left(\frac{B}{A}\right)$$

$\alpha_c(X)$, the attenuation per unit length, will be of a different form than in the waveguide.

The complete reflection coefficient at X = O is Eq. 3

$\Gamma_{Total} = \Gamma_{Tap} + \Gamma_{Dis} + \Gamma_M$

Where each term is a complex number, and, therefore, vector addition must be used.

The phase shift through the waveguide impedance standard is given by $$\phi_w = \frac{2\pi}{\lambda_g} L \qquad \text{Eq. 4}$$

The phase shift through the coaxial impedance standard is given by $$\phi_e = \frac{2\pi}{\lambda} L \qquad \text{Eq. 5}$$

The attenuation of the waveguide impedance standard is given by $$\alpha_w = \int_o^L \alpha_w (X)\, dX \qquad \text{Eq. 6}$$

and for the coaxial impedance standard by $$\alpha_c = \int_o^L \alpha_c (X)\, dX \qquad \text{Eq. 7}$$

The following illustrative example describes the calibration of an automatic network analyzer. The two port standard will be inserted at the insertion point which is between the generator and the detector. The analyzer will measure the transmission coefficient and the reflection coefficient as a function of frequency. (Note that the mathematically derived quantities of reflection coefficient and transmission coefficient are a function of λ (wavelength. However, wavelength and frequency are mathematically related). If in the measurement, the discontinuity of the two port impedance standard were connected to the effective generator port of the analyzer, the mismatch of the detector port could be evaluated. If the discontinuity is connected to the effective detector port of the analyzer, the mismatch of the (effective generator) port can then be evaluated. Various values of B″ and L will also be measured by the analyzers. The automatic network analyzer could then use the measured data and the mathematically defined data to correct any errors therein and thus be ready to make routine measurements.

The present impedance standard utilizes a linear taper and has a predetermined length and cross-sectional dimensions in a given operating range. The linear taper of the impedance standard is easily constructed and thus may be readily duplicated. In addition, since the impedance standard is of known length and cross-sectional dimensions, it is mathematically predictable. Since the standard is mathematically predictable, it does not require a highly accurate reference section to be used with it. The impedance standard can be used as a one-port or as a two-port standard without the use of a reference section. Further, the known length and cross-sectional dimensions of the standard permit it to be used as a two-port standard of phase shift, reflection coefficient, and attenuation.

Although the invention has been described with reference to a particular embodiment, it will be understood to those skilled in the art that the invention is capable of a variety of alternative embodiments within the spirit and scope of the appended claims.

What is claimed is:

1. An impedance standard apparatus for producing known reflections comprising in combination:

taper forming means having a predetermined length, said taper forming means having a first and second end, said first and second end respectively having the same cross-sectional area and shape, said first end having a first predetermined dimension, said second end having a second predetermined dimension, said first predetermined dimension being larger than said second predetermined dimension, said taper forming means with said first and second end provides a two-port device with a mathematically predictable VSWR, said two-port device being inserted between a matched generator and load, and means for connecting joined to said taper forming means, said connecting means attached to said first and second end respectively of said taper forming means, said connecting means being substantially identical.

2. An impedance standard apparatus as described in claim 1 wherein said taper forming means has a linear taper.

3. An impedance standard apparatus as described in claim 1 wherein said taper forming means has a non-linear taper.

4. An impedance standard apparatus as described in claim 1 wherein said predetermined length is related to the operating frequency range.

5. An impedance standard apparatus as described in claim 1 wherein said taper forming means produces a predetermined reflection within the operating frequency range.

6. An impedance standard apparatus as described in claim 1 wherein said taper forming means produces a predetermined known reflection over the entire operating frequency range.

7. An impedance standard apparatus as described in claim 1 wherein said predetermined length and said first and second predetermined dimension are scaled in relation to the frequency band of operation.

* * * * *

UNITED STATES PATENT AND TRADEMARK OFFICE

CERTIFICATE OF CORRECTION

PATENT NO. : 3,970,973

DATED : July 20, 1976

INVENTOR(S) : Frank Lazzaro

It is certified that error appears in the above-identified patent and that said Letters Patent are hereby corrected as shown below:

Column 4, line 26 leave at least three spaces between "x=0" and "$Z_2$" to maintain separation therebetween line 27 leave at least three spaces between "x=L" and "$Z_3$" to maintain separation therebetween line 30 change "$B=2\pi\lambda g$" to --$B=2\pi/\lambda g$--

Signed and Sealed this

*Third* Day of *July 1979*

[SEAL]

*Attest:*

*Attesting Officer*

LUTRELLE F. PARKER

*Acting Commissioner of Patents and Trademarks*